US007571551B1

(12) United States Patent
Anderson

(10) Patent No.: US 7,571,551 B1
(45) Date of Patent: Aug. 11, 2009

(54) APPARATUS AND METHOD FOR RAISING AND SPACING ROOF TRUSSES

(76) Inventor: Todd J. Anderson, 24549 Park Dr., Chugiak, AK (US) 99587

( * ) Notice: Subject to any disclaimer, the term of this patent is extended or adjusted under 35 U.S.C. 154(b) by 0 days.

(21) Appl. No.: 12/001,663

(22) Filed: Dec. 11, 2007

(51) Int. Cl.
*G01D 21/00* (2006.01)

(52) U.S. Cl. ..... 33/613

(58) Field of Classification Search ..... 33/613, 33/645, 533
See application file for complete search history.

(56) References Cited

U.S. PATENT DOCUMENTS

| | | | | | |
|---|---|---|---|---|---|
| 2,686,959 | A * | 8/1954 | Robinson | 33/613 |
| 2,806,495 | A * | 9/1957 | Merkle et al. | 269/45 |
| 3,161,964 | A * | 12/1964 | Myles | 33/353 |
| 3,201,874 | A * | 8/1965 | Christy | 33/613 |
| 3,851,868 | A * | 12/1974 | Lagasse | 33/194 |
| 4,420,921 | A * | 12/1983 | Hardin | 33/613 |
| 4,462,166 | A * | 7/1984 | Furlong | 33/416 |
| 4,704,829 | A * | 11/1987 | Baumker, Jr. | 33/613 |
| 5,628,119 | A * | 5/1997 | Bingham et al. | 33/613 |
| 5,937,531 | A * | 8/1999 | Menk et al. | 33/613 |
| 6,293,028 | B1 * | 9/2001 | Sylvia | 33/613 |
| 6,868,613 | B2 * | 3/2005 | Sumner | 33/194 |
| 6,895,684 | B1 * | 5/2005 | Firth | 33/613 |
| 6,935,041 | B2 * | 8/2005 | Orton | 33/613 |
| 7,152,338 | B2 * | 12/2006 | Thompson et al. | 33/613 |
| 2007/0119067 | A1 * | 5/2007 | Mackey | 33/613 |

* cited by examiner

*Primary Examiner*—Yaritza Guadalupe-McCall
(74) *Attorney, Agent, or Firm*—Michael J. Tavella

(57) ABSTRACT

A tool that enables workers to pull up trusses from a stored position to their upright position and then automatically space them correctly. It has a rectangular body that has markings on it for proper spacing and a pair of clamp members attached. One of the clamp members is fixed at the end of the body. The second clamp is adjustable as desired to achieve the correct truss spacing. The clamps can have spring clips on them to ensure a tight hold on the truss. At the rear of the body is an extension handle. This handle is pulled out of the rear of the device to the desired length. The extension handle is used provide workers enough space to be able to easily lever up a truss.

18 Claims, 5 Drawing Sheets

APPARATUS AND METHOD FOR RAISING AND SPACING ROOF TRUSSES

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to tools and methods used to raise and space trusses and particularly to a single tool and method for raising and spacing trusses.

2. Description of the Prior Art

In modern frame construction, roofs are typically supported by a series of trusses. These are usually made of wood or metal, and have a complex structure. They must be positioned above the top story of a building at regularly spaced intervals. Trusses typically have a lower beam called a tie plate that holds the lower angled ends of a truss together. This plate is positioned on the top plates of the top story and secured in place. This often requires two or three workers. First, the truss is raised into position and clamped to the proper location. Then, it is secured with nails or other fasteners. The next truss is then raised and must be positioned at the proper interval, 24 inches for example. This requires measurements to verify that the proper spacing is accomplished. Then, the truss can be secured as before. This procedure is repeated for each truss in the roof system. Bear in mind that this work is done two or more stories in the air, often working on the top plates or ladders while moving heavy, awkward work pieces.

Tools to help raise and space trusses have been invented over the years to assist in the process. Some of these are found in the following U.S. Pat. No. 3,201,874, to Christy teaches a bar that has finger-type two spring clamps on the ends. The tool is used by placing the first finger clamp on a member already in position and then placing a second member in the second spring clamp. Once secured, the second member is in the proper position for fastening. The tool has a fixed bar for only one spacing and cannot be used to raise a truss. U.S. Pat. No. 5,161,345 to Sobjack, Sr. teaches a strap that has nail holes at regularly spaced apart intervals. This device is used by first erecting and securing the two outermost trusses of the building. Then, the remaining trusses are raised and stacked against one of the standing trusses. Then, the strap is unrolled and fixed to the two outermost trusses. Once the strap is extended, the remaining trusses are moved, one by one, to their positions and aligned with the nail hole in the strap. Once all the trusses are fixed in place, the strap is not removed. Rather, it becomes a permanent part of the roofing system. U.S. Pat. No. 5,628,119 to Bingham et al. teaches a device similar to that of the Christy patent above. In Bingham, the device is adjustable so that it can be set for different spacing. Note that both Christy and Bingham are to be used in general framing and are not limited to working with trusses. U.S. Pat. No. 6,993,882 to Crawford et al. teaches a brace that is made at a fixed spacing. It is used to ensure proper spacing of trusses and is designed as a brace to be left in place as part of the roofing system. It cannot be used to help raise trusses into an upright position. Finally, U.S. Pat. No. D318,785 to Dean teaches a truss spaced that is similar to the Christy patent with minor differences in the clamp shape.

All of these patents teach tools useful for spacing trusses, but not for raising trusses. Some tools exist for raising trusses, but these are poles that are used to push trusses into an upright position from below; they cannot be used to space the trusses. Thus, there is a need for tool that can be used to help raise trusses and space them that is not intended to be left in place, so that it can be used repeatedly.

BRIEF DESCRIPTION OF THE INVENTION

The instant invention is a tool that enables workers to pull up trusses from a stored position to their upright position and then automatically space them correctly. It has a rectangular body that has markings on it for proper spacing and a pair of clamp members attached. One of the clamp members is fixed at the end of the body. The second clamp is adjustable as desired to achieve the correct truss spacing. The clamps can have spring clips on them to ensure a tight hold on the truss. At the rear of the body is an extension handle. This handle is pulled out of the rear of the device to the desired length. The extension handle is used to provide workers enough space to be able to easily lever up a truss.

To use the tool a pair of workers (standing on opposite sides of the top plates) place the rear clamps of two devices on the side or top member of the next truss to be raised. Then, using the fully extended handle, the workers pull up the truss into its upright position. Then the workers position the bottom member by securing the front clamp to the adjacent, already installed, truss. In setting the forward clamp on the last truss set, the device automatically positions the new truss at the proper spacing. The workers can then secure the last truss in place before moving on to the next truss.

DETAILED DESCRIPTION OF THE INVENTION

Figure 1:
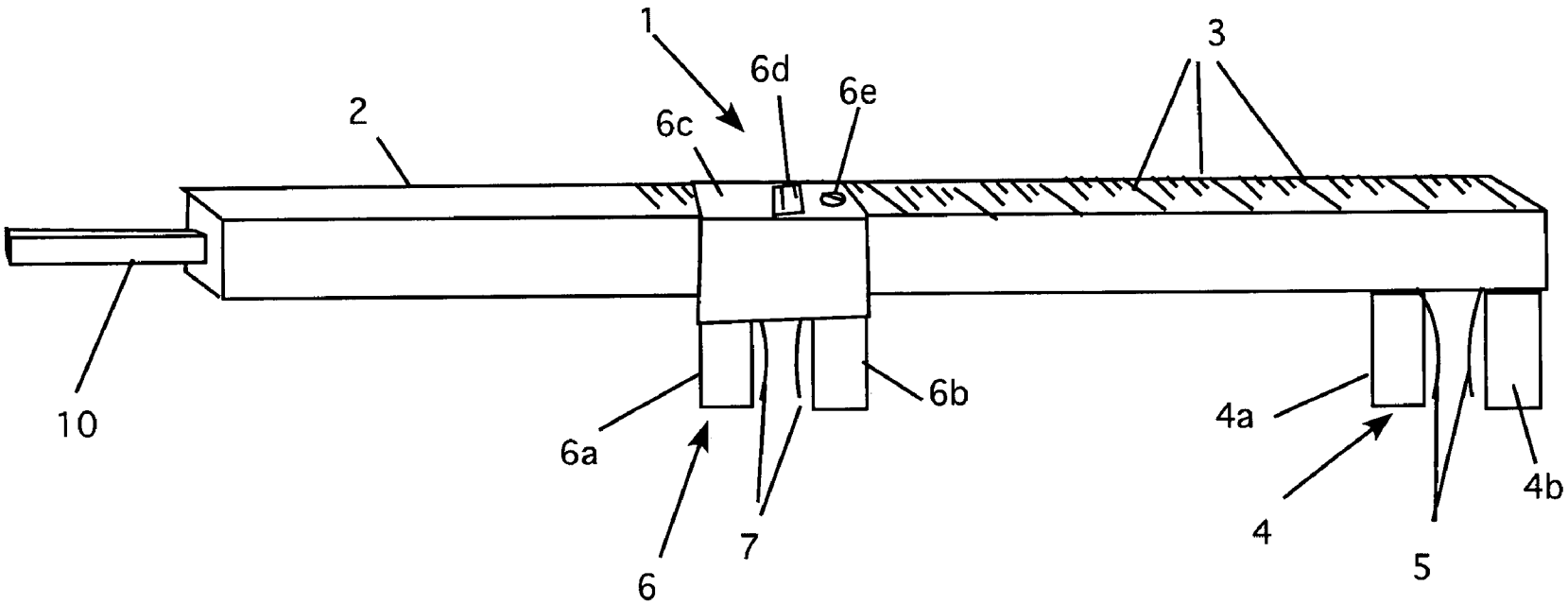
FIG. 1 is a side perspective view of the device with the extension handle retracted.

Referring now to FIG. 1, a side perspective view of the device with the extension handle retracted is shown. The tool 1 has a rectangular body 2 that has a square cross-section. Along the top of the tool are measuring marks 3 that indicate standard measurements (inches, mm, etc.). These marks are used to position the movable clamp in the proper location for use. At the front of the body is a fixed clamp 4. The clamp has two members 4*a* and 4*b* that are spaced apart 1.5 inches, which is the width of the standard truss plate. Optional spring clips 5 can be installed between the clamp members as shown to ensure the clamp has a tight grip on the truss member. A second clamp 6 is installed along the body as shown. The second clamp 6 is also made up to two members 6*a* and 6*b* that extend down from the body. However, these clamp members are not fixed. The two members 6*a* and 6*b* are attached to a plate 6*c* that is positioned on the main body a shown. The plate is designed to slide freely on the main body. A window 6*d* with an indicator line is positioned on the plate so that the user can locate the clamp 6 in the proper position. A setscrew 6*e* is used to secure the clamp 6 in its desired location by aligning the indicator line with the appropriate marks 3 on the tool. This clamp can also have the optional spring clips 7 to ensure a tight fit on the truss members.

At the rear of the body 2 is an extension handle 10. The extension handle is stored in the tool, when not in use, but is extended when installing trusses.

Figure 2:
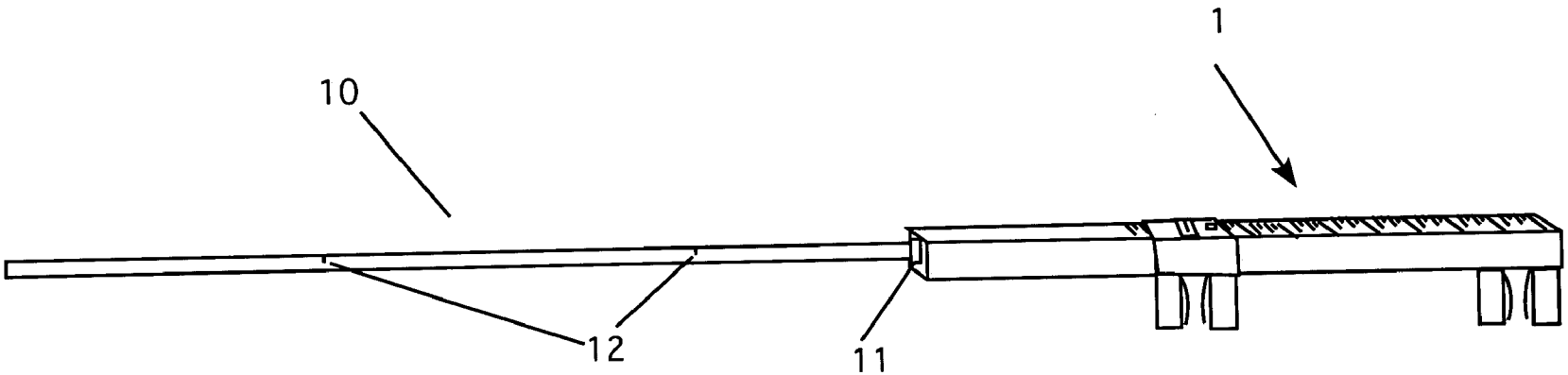
FIG. 2 is a side perspective view of the device with the extension handle extended.

FIG. 2 is a side perspective view of the device with the extension handle extended. Here, the tool 1 is shown with the extension handle 10 fully extended. This handle provides a worker leverage when raising trusses, as discussed below. As before, when the handle is extended, it can be locked in place to prevent it from moving during operation. Note the handle is designed to be friction fit within the tool, but can have a locking device to hold it in place for use. The locking device can be a ring 11 that is twisted to lock the handle when it is fully extended. Note that the handle can be segmented to telescope instead of being a single piece. FIG. 2 shows dashed lines 12 that indicate optional telescoping points.

Figure 3:
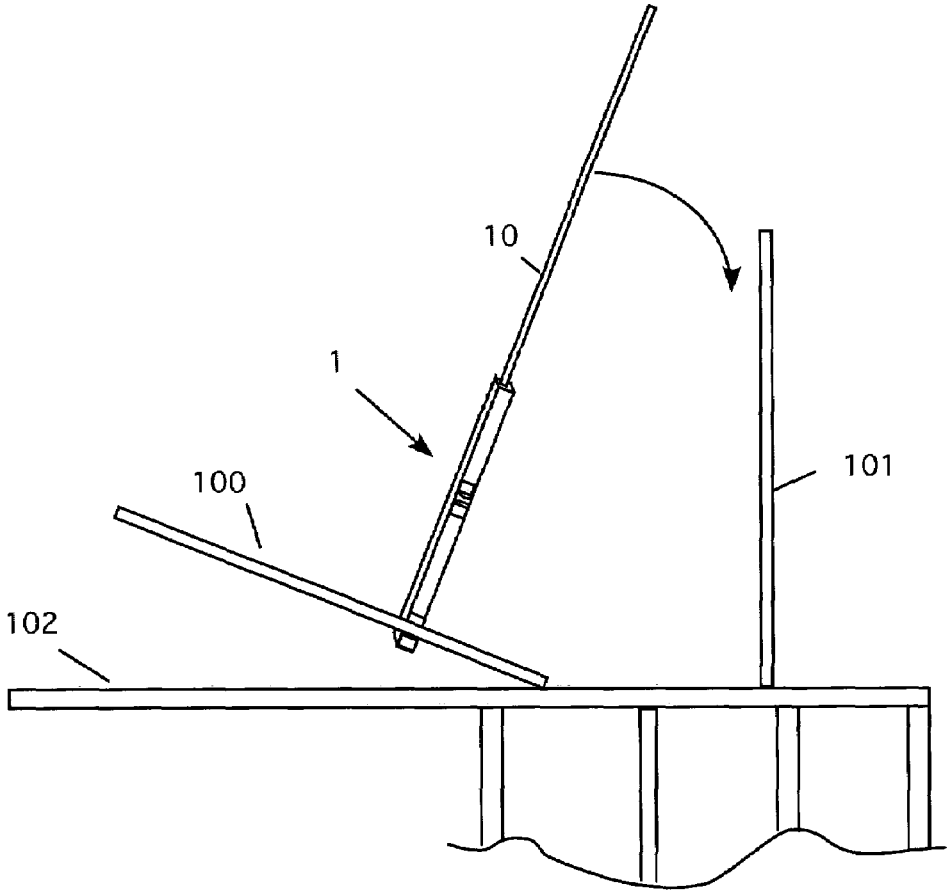
FIG. 3 is a detail view of the tool installed on a truss at the beginning of the lift, showing the direction of pull to raise the truss.

FIG. 3 is a detail view of the tool installed on a truss showing the direction of pull to raise the truss. In this figure, the tool is shown at work. A truss 100 is shown slightly raised from its original position on top of the top plate 102. Another truss 101 is shown already in position on the top plate 102. The front clamp 4 is placed on the side or top member of the truss 100 about 3 feet above the bottom, as shown. A worker, standing behind the tool and holding the extension handle 10 pulls upward in the direction of the arrow to raise the truss 100 to its upright position. In the preferred embodiment, two workers stand at opposite sides of the truss and act together to raise the truss using two tools.

Figure 4:
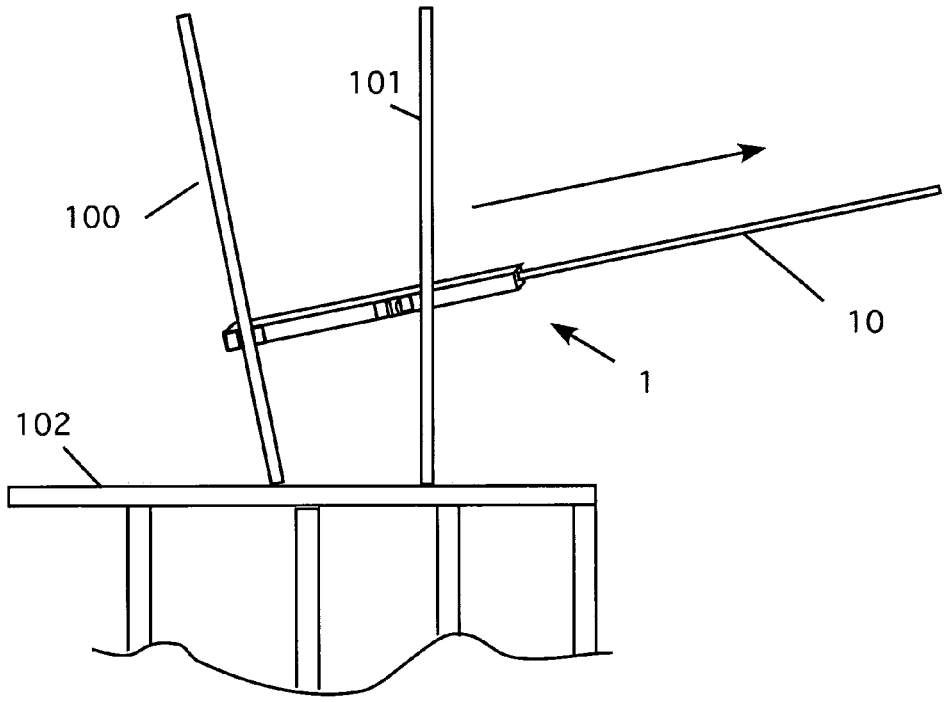
FIG. 4 is a detail view of the truss in an intermediate position while being raised to its upright position and the tool positioned to space the truss in its proper position.

FIG. 4 is a detail view of the truss 100 being raised to an intermediate position. As the truss becomes more upright, the worker level off the tool to be in position to set it in place. Here, the sliding clamp 6 is approaching the previously set truss 101

Figure 5:
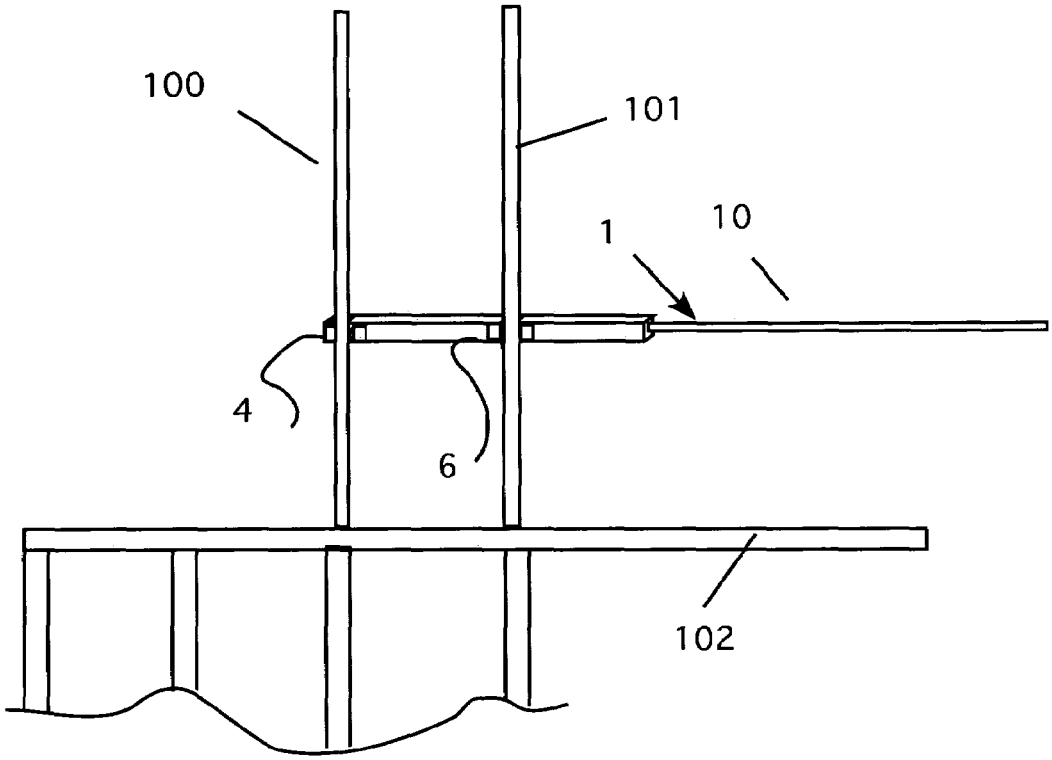
FIG. 5 is a detail view of the truss in an upright position with the tool positioned to space the truss in its proper position.

FIG. 5 is a detail view of the truss raised to its upright position and the tool positioned to space the truss in its proper position. Here, the workers have stood the truss 100 to its upright position. The workers then maneuver the top or side member of the truss 100 until the sliding clamp 6 of the tool engages the top or side member of the truss 101 as shown. With both clamps on the truss members, the truss 100 is properly spaced for nailing to the top plate 102.

In this way, workers can quickly, efficiently, and safely install a number of trusses with no errors of placement.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An apparatus for raising and spacing roof trusses comprising:

a) a generally rectangular member having a front, a back, a top and a bottom;

b) a fixed clamp, attached to the bottom front of said generally rectangular member and extending downwardly therefrom;

c) a second clamp member, slidably attached to said generally rectangular member such that said second clamp member slides along the bottom of said generally rectangular member, and extending downwardly therefrom; and d) an extension handle, slidably installed in said generally rectangular member and extending outwardly from the back therefrom, said extension handle having a first position wherein the greater extent of said extension handle is contained within said generally rectangular member, and a second, extended position, wherein said extension handle is extended outward from said generally rectangular member such that the greater extent of said extension handle is outside of said generally rectangular member.

2. The apparatus of claim 1 further comprising, a plurality of markings, formed on said generally rectangular member.

3. The apparatus of claim 1 further comprising a means for locking said second clamp in a desired position on said generally rectangular member.

4. The apparatus of claim 1 wherein means for locking said second clamp in a desired position is a setscrew.

5. The apparatus of claim 2 further comprising a means for aligning said second clamp member with said plurality of markings.

6. The apparatus of claim 5 wherein the means for aligning said second clamp member with said plurality of markings includes a window formed in said second clamp member.

7. The apparatus of claim 1 further comprising a pair of spring clips attached to said fixed clamp.

8. The apparatus of claim 1 further comprising a pair of spring clips attached to said second clamp member.

9. A method of erecting and positioning trusses using a tool having a generally rectangular member having a front, a back, a top and a bottom; a fixed clamp, attached to the bottom front of said generally rectangular member and extending downwardly therefrom; a second clamp member, slidably attached to said generally rectangular member and extending downwardly therefrom; and an extension handle, slidably installed in said generally rectangular member and extending outwardly from the back therefrom, said extension handle having a first position wherein the greater extent of said extension handle is contained within said generally rectangular member, and a second, extended position, wherein said extension handle is extended outward from said generally rectangular member such that the greater extent of said extension handle is outside of said generally rectangular member, wherein a first truss in a vertical position, comprising the steps of:

a) positioning the fixed clamp on a truss that is in a horizontal position;

b) extending the extension handle to the second position;

c) lifting the truss to a vertical position using the extension handle as a leverage aid;

d) moving said truss until the second clamp member engages the first truss; and e) securing said truss in place.

10. The method of claim 9 wherein the tool further comprises a means for locking the second clamp member in a position on said generally rectangular member.

11. The method of claim 9 further comprising the steps of:

a) prior to step a, sliding said second clamp member to a desired position on the generally rectangular member; and b) engaging the means for locking the second clamp member to secure the second clamp member in a desired location.

12. The method of claim 9 wherein the tool further comprises a means for locking the extension handle in a second position.

13. The method of claim 9 further comprising the step of:

a) after step b, engaging the means for locking the extension handle to secure the extension handle in the extended position.

14. A method of erecting and positioning trusses using a pair of tools, each having a generally rectangular member having a front, a back, a top and a bottom; a fixed clamp, attached to the bottom front of said generally rectangular member and extending downwardly therefrom; a second clamp member, slidably attached to said generally rectangular member and extending downwardly therefrom; and an extension handle, slidably installed in said generally rectangular member and extending outwardly from the back therefrom, said extension handle having a first position wherein the greater extent of said extension handle is contained within said generally rectangular member, and a second, extended position, wherein said extension handle is extended outward from said generally rectangular member such that the greater extent of said extension handle is outside of said generally rectangular member, wherein a first truss in a vertical position, comprising the steps of:

a) positioning the fixed clamp of one of said pair of tools on a truss that is in a horizontal position;

b) positioning the fixed clamp of the other of said pair of tools on a truss that is in a horizontal position;

c) extending the extension handle of each of said pair of tools to the second position;

c) lifting the truss to a vertical position using the extension handles on both of said pair of tools simultaneously as a leverage aid;

d) moving said truss until the second clamp member of each of the pair of tools engages the first truss; and e) securing said truss in place.

15. The method of claim 14 wherein each of said pair of tools further comprises a means for locking the second clamp member in a position on said generally rectangular member.

16. The method of claim 15 further comprising the steps of:

a) prior to step a, sliding said second clamp member on each of said pair of tools to a desired position on the generally rectangular member; and b) engaging the means for locking the second clamp member on each of said pair of tools to secure the second clamp member in a desired location.

17. The method of claim 14 wherein each of said pair of tools further comprises a means for locking the extension handle in a second position.

18. The method of claim 17 further comprising the step of:

a) after step b, engaging the means for locking the extension handle on each of said pair of tools to secure the extension handle on each of said pair of tools in the extended position.

* * * * *